US005489820A

United States Patent [19]

Ivanov et al.

[11] Patent Number: 5,489,820

[45] Date of Patent: Feb. 6, 1996

[54] METHOD OF CONTROL OF PLASMA STREAM AND PLASMA APPARATUS

[75] Inventors: Vladimir Ivanov; Pavel P. Kulik; Alexis N. Logoshin, all of Moscow, U.S.S.R.

[73] Assignee: Overseas Publishers Association, Amsterdam, Netherlands

[21] Appl. No.: 16,217

[22] Filed: Feb. 11, 1993

[30] Foreign Application Priority Data

Feb. 18, 1992 [SU] U.S.S.R. ..... 5026317

[51] Int. Cl.[6] ..... H05H 1/16

[52] U.S. Cl. ..... 315/111.51; 315/111.21

[58] Field of Search ..... 315/111.01, 111.11, 315/111.21, 111.31, 111.41, 111.51, 111.61, 111.71, 111.81, 111.91

[56] References Cited

U.S. PATENT DOCUMENTS

| | | | |
|---|---|---|---|
| 3,786,306 | 1/1974 | Schoumaker | 315/111.21 |
| 3,916,034 | 10/1975 | Tsuchimoto | 315/111.01 |
| 4,009,413 | 2/1977 | Elliott et al. | 315/111.21 |
| 4,390,773 | 1/1983 | Esser et al. | 315/111.21 |
| 4,812,166 | 3/1989 | Saiki et al. | 315/111.51 |
| 4,982,067 | 1/1991 | Marantz et al. | 315/111.21 |
| 5,062,708 | 11/1991 | Liang et al. | 315/111.21 |

FOREIGN PATENT DOCUMENTS 1589562 4/1970 Germany .

*Primary Examiner*—Richard A. Bertsch
*Assistant Examiner*—Roland G. McAndrews, Jr.
*Attorney, Agent, or Firm*—Lowe, Price, LeBlanc & Becker

[57] ABSTRACT

A plasma stream is formed by plural plasma-forming gas through which electric currents are passed and on which a magnetic field is superposed a physical parameter of the plasma stream is monitored. The magnitude of force acting on one of the jets is varied until a required result is obtained. Plural plasma burners arranged at an angle to each other are connected to a power supply and a plasma-forming gas source. Each burner incudes an open magnetic circuit with a solenoid connected to another power supply. The physical parameters of the plasma stream are recorded. The recorder is connected to a processor having connected to both power supplies and plasma-forming gas source. The burners include a drive also connected to the processing unit.

27 Claims, 4 Drawing Sheets

METHOD OF CONTROL OF PLASMA STREAM AND PLASMA APPARATUS

The present invention relates to plasma treatment technique and, more particularly, the invention relates to a method of control of a plasma jet and to a plasma apparatus.

The invention can be used in the electronic industry, mechanical engineering, instrumentation and in other fields of science and technology where the plasma treatment is used.

Known in the art is a method of control of a plasma stream, in which the stream is formed by a system of converging plasma jets, and characterized in that a magnetic system is used for superposing magnetic fields on the current-conducting plasma jets. This procedure makes it possible to change the characteristics of the plasma stream, such as its shape, size, and the position of the plasma jets, by varying the magnetic field intensity. This method, however, has disadvantages since it does not provide control of the characteristics of the total plasma stream which is very important for the final results of the plasma treatment, such as the radiation brightness distribution in the plasma stream cross-section, or the distribution of the density of ions and active atoms near the surface being treated. Furthermore, the prior art method does not provide a possibility of accurate reproduction of the plasma stream parameters having the same longevity (PCT 90/00286 of Dec. 26, 1990, IPC HO5 B 7/22).

Also known in the art is a device for controlling a plasma stream (PCT 90/00266 of Dec. 26, 1990, IPC HO5 B 7/22) comprising two plasma burners whose longitudinal axes are disposed at an angle to each other. The plasma burners are connected to an electric current supply and communicate with a source of a plasma-forming gas. Each plasma burner is provided with a magnetic system made in the form of an open magnetic circuit with a solenoid connected to a power supply source. This prior art device has all the disadvantages of the above-described method.

A basic object of the invention is to provide a method for controlling a plasma stream formed by plasma-forming jets which would allow one to obtain preset physical parameters of the total plasma stream.

This object is attained by providing a method of control of a plasma stream formed by at least two plasma-forming gas jets, through which an electric current flows and a magnetic field is superposed on each plasma jet; according to the invention, one of the physical parameters of the total plasma stream is monitored and, in the case of its change, an appropriate action is taken on at least one of the converging plasma jets until the preset or required physical parameters of the total plasma stream are attained.

An advantage of the proposed method for controlling a plasma stream formed by plasma jets is a possibility of continuous monitoring of all physical parameters of the total plasma stream which affect the treatment of products. The continuous checking of the parameters and control of the plasma jets make it possible to change the plasma stream characteristics or, on the other hand, by continuously correcting these characteristics, the physical parameters can be kept constant over a certain period of time. Such a method of control allows one to use the same plasma apparatus for performing various operations of the treatment by presetting necessary values of the physical parameters of the total plasma stream.

One of the physical parameters of the total plasma stream is its cross-sectional dimension. Therefore, the cross-sectional dimension of the total plasma stream is monitored and modified by changing the intensity of the magnetic field superposed on at least one plasma jet. The cross-sectional dimension of the total plasma stream determines the specific heat content at a given power transmitted to the plasma-producing electric discharge. The specific heat content, in turn, determines the result of treatment of the final product. The treatment result can be maintained constant due to the jet size reproduction.

The cross-sectional dimension of the total plasma stream can be changed both by varying the superposed magnetic field and by varying the plasma-forming gas flow rate. A higher flow rate of the plasma-forming gas results in a decrease of the dimension of the total plasma stream since the higher dynamic head of the jet restrains an increase of the cross-sectional dimension of the stream.

There is still another method of changing the cross-sectional dimension of the plasma stream in which the angle of convergence of the plasma jets is controlled. By increasing the angle between the directions of the outflowing jets, one can decrease the cross-sectional dimension of the total plasma stream and vice versa.

The brightness distribution of the total plasma stream is also monitored and corrected by controlling the intensity of the magnetic field superposed on at least one plasma jet. The brightness distribution depends on the distribution of the plasma temperature and, therefore, the distribution of the excited atoms, molecules, ions and electrons in the plasma, i.e. the active particles in the reaction zone in the process of plasma treatment of a surface. Therefore, the results of the reaction between the plasma and the surface to be treated will depend on the brightness distribution. By presetting the magnitude of brightness distribution, one can change the intensity of the physical and chemical action on the surface being treated. If this distribution is reproduced in the process of the following treatments and kept at the same level, it is possible to stabilize the result of such a treatment.

A more important characteristic of the plasma stream, compared to the brightness distribution in the stream cross-section, is the distribution of the spectral radiation factor of ions, atoms, radicals and molecules. In the first approximation, the radiation intensity is proportional to the concentration of the above particles. The surface plasma treatment rate and quality depend on the concentration of the active plasma components. In this connection, it is desirable to have information on the spectral radiation factor of a plasma jet, which enables one to determine the concentration of active particles in the total plasma stream, and, by changing the composition of the plasma-forming gas or its flow rate, to control the distribution of spectral radiation in the total plasma stream.

It is reasonable to trace directly the concentration of ions in the plasma stream and, acting on the converging plasma jets by varying the composition of the plasma-forming gas or its flow rate in at least one jet, to change the concentration of ions in the total plasma stream, because during the interaction of the plasma stream with the surface being treated, the plasma properties suffer significant changes, and the plasma loses it equilibrium physically and chemically while the interpretation of the spectral data under these conditions is very difficult.

It is also necessary to monitor the distribution of the heat flow in the plasma jet and to perform a physical action on the converging jets to obtain the preset values of the heat flow distribution in the total plasma stream. The physical action is effected by controlling the electric current flowing through the plasma jets. This is necessary because, in addition to the flows of active particles to the surface being treated, the plasma jet transfers a lot of heat to this surface. This heat warms up the surface being treated and affects the rate of the chemical reactions and, therefore, the uniformity and quality of the treatment.

The proposed method can be carried into effect by means of a plasma apparatus comprising at least two plasma burners disposed at an angle to each other, connected to a power supply and communicating with a source of a plasma-forming gas. Each plasma burner is provided with a magnetic system made in the form of an open magnetic circuit with a solenoid connected to a power supply. The magnetic system has a unit for recording the physical parameters of the plasma stream connected to a processing unit whose outputs are connected to the power supply of the plasma burners and/or solenoid, and/or the plasma-forming gas source.

Such as apparatus capable of checking the physical parameters of the plasma stream makes it possible to perform the above-described method in a simple manner, for example, when the unit for recording the physical parameters is made in the form of an optical system installed so that its optical axis intersects the longitudinal axis of the plasma stream and a light-sensitive cell is installed in the image plane of the optical system.

The light-sensitive cell may be made of a string of photodetectors enabling one to check the brightness distribution in the plasma stream cross-section.

If the above-described unit for recording the physical parameters is provided with a dispersing element installed between the optical system and the light-sensitive cell, it is possible to monitor the distribution of the spectral radiation factor in the plasma stream.

In order to monitor the heat flow distribution, the unit for recording the physical parameters may be made as a thermocouple installed so that it is in contact with the plasma stream in its cross section.

Since the concentration of ions in the plasma stream influences the plasma electrical conductivity, at least one electric probe made in the form of a pair of electrodes may be used as a recording unit to monitor the ion concentration. This electric probe is installed so that some ends of the electrodes are in contact with the plasma stream while the other ends are connected to a power supply and a current meter. The whole unit is installed with a possibility of crossing the longitudinal axis of the plasma stream.

The invention will be better understood from the following detailed description of some specific embodiments of the invention, which do not limit the scope of the same, and with reference to the accompanying drawings, in which.

Figure 8:
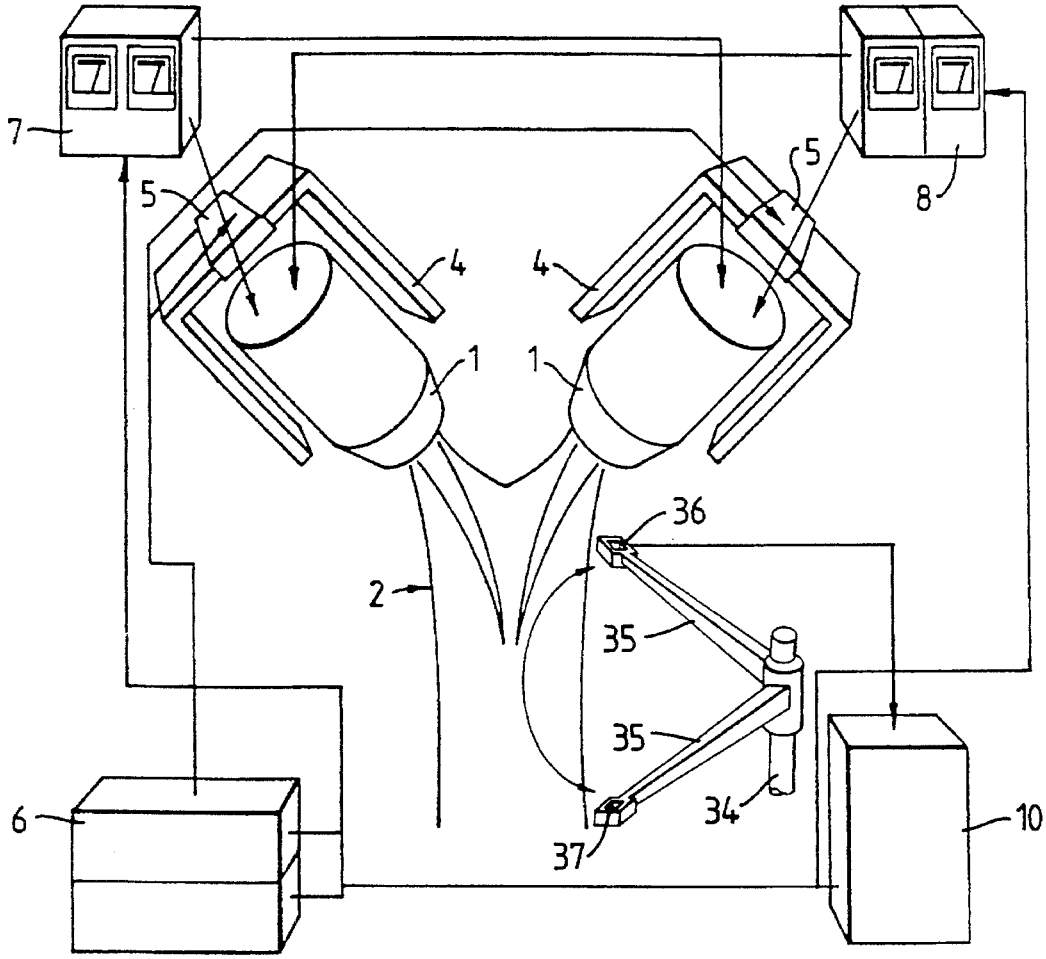
Figure 9:
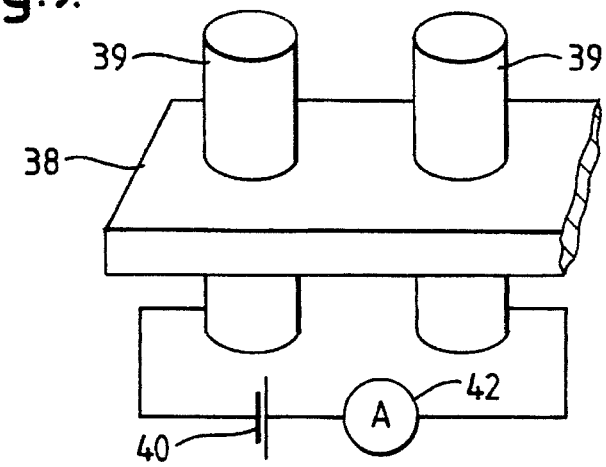

FIG. 8 a schematic view of the apparatus with a thermocouple as a recording unit;

FIG. 9 is a very simple embodiment of the electric probe.

Figure 1:
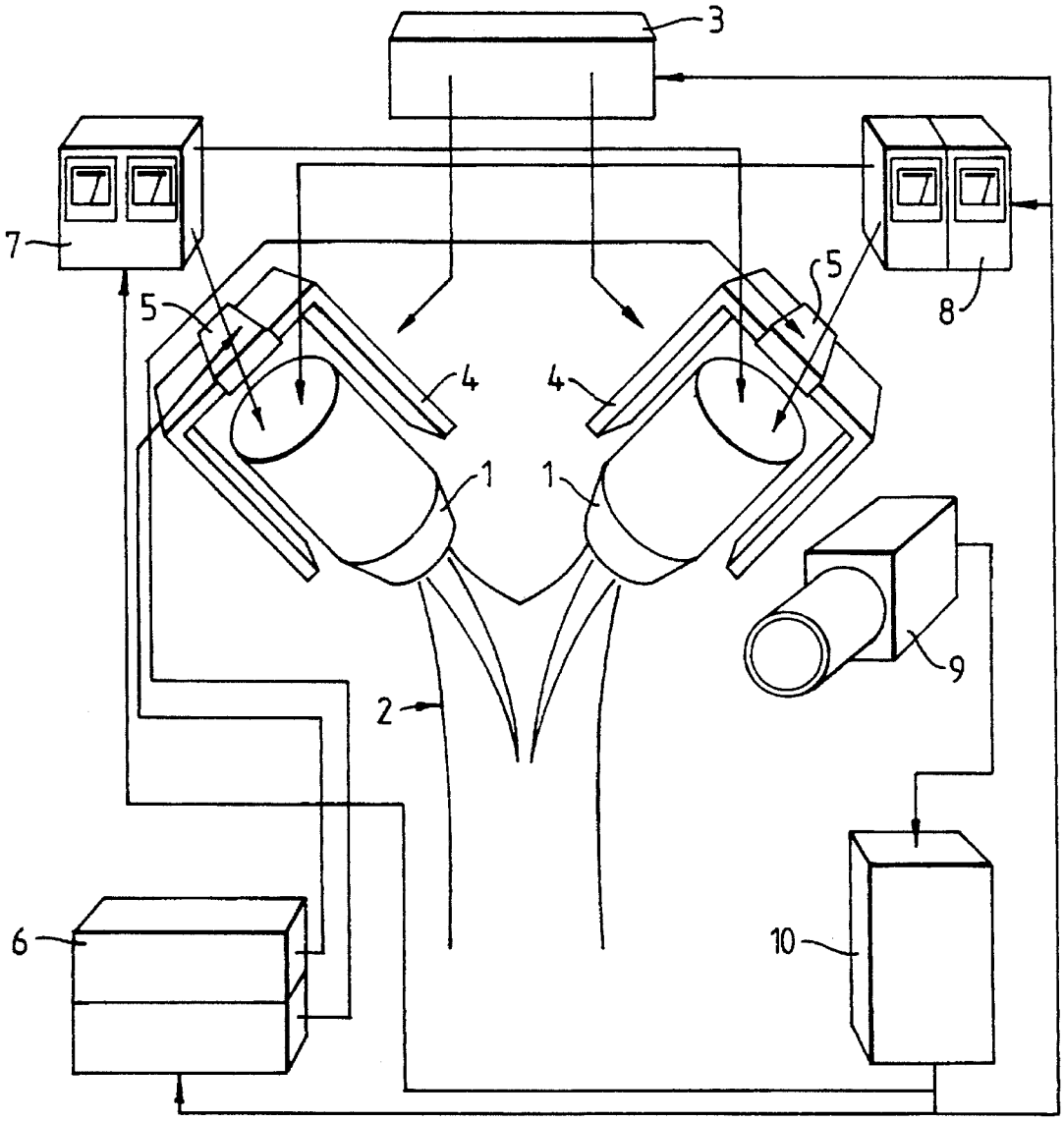
FIG. 1 is a general view of the apparatus.

Referring to FIG. 1, consider the operation of the proposed plasma apparatus to clarify the essence of the proposed method.

Figure 2:
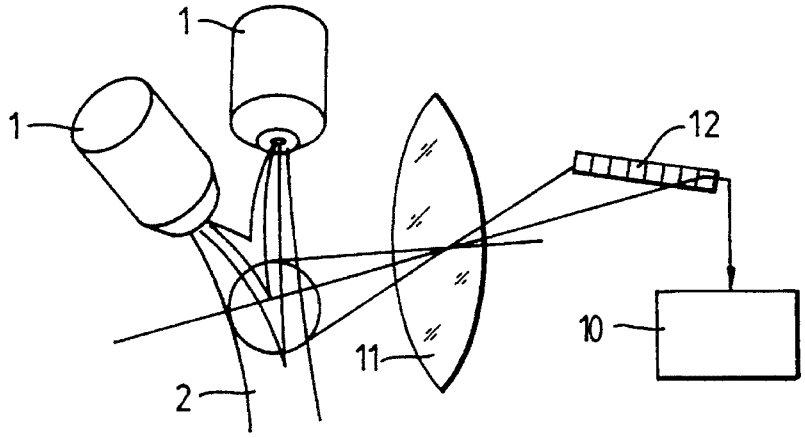
FIG. 2 shows the optical recording unit with light-sensitive cells.
Figure 3:
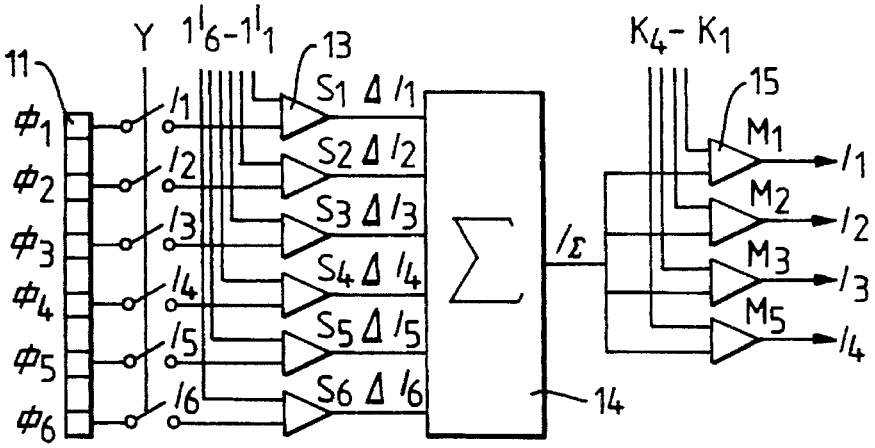
FIG. 3 is a simple diagram of the processing unit.

Shown in FIG. 1 is the simplest embodiment of the proposed apparatus. This apparatus comprises two plasma burners 1 arranged at an angle of 90° to each other and produce a total plasma stream 2. The burners are provided with an electric drive 3 allowing the angle and distance between them to be varied. Each burner 1 is equipped with a magnetic system consisting of open magnetic circuits 4 carrying solenoids 5 connected to a current supply 6. The magnetic circuits 4 are made of electrical steel with a cross section of 0.3 $cm^2$. The solenoids 5 consist of 1000 turns of a copper wire. The plasma burners 1 are connected to a power supply 7, which is a d.c. voltage source; the positive terminal of the power supply is connected to one plasma burner and the negative terminal is connected to the other burner. In addition, each burner 1 is fed with a plasma-forming gas from a supply system 8. The apparatus comprises a recording unit 9 connected to a processing unit 10 whose outputs can be connected to the inputs of the electric drive 3, power supply 6 of the solenoids, power supply 7, and plasma-forming gas supply system 8. Let us consider the recording unit in the form of an embodiment with an optical detector shown in FIG. 2, where the elements similar to those in FIG. 1 have the same reference numerals. The recording unit shown in FIG. 2 is a single-element lens 11 whose optical axis intersects the longitudinal axis of the plasma stream 2 and has a string of photodiodes 12 whose outputs are connected to the inputs of the processing unit 10. The simplest version of the processing unit 10 is shown in FIG. 3. This unit is a system of primary adders 13, one input of each adder receiving the data on the electric currents from the string of photodiodes 12 and the other input being fed with preset values of these currents. The outputs of the primary adders 13 are connected to the inputs of a common adder 14. In turn, the signal from the common adder 14 is applied to one of the inputs of multipliers 15, and weighting factors are applied to the second input of these multipliers. The outputs of the multipliers 15 are outputs of the processing unit 10 and, for example, are connected to the control inputs of the drive 3. The weighting factors are found experimentally. Each weighting factor reflects the degree of change of the observed parameters of the plasma stream in response to a given physical action. The factor value is lower, as the rate of change of the parameter of the plasma stream becomes greater for a corresponding unit of action.

The installation operates as follows.

The plasma burners 1 are supplied with nitrogen through the plasma-forming gas supply system 8, and an electric d.c. current of 100 A from the power supply 7 flows between the burners 1 through the plasma jets. The outflow plasma jets form a total plasma stream 2. The initial direction of the plasma jets is determined by setting a required position of the burners by means of the drive 3. A required size of the plasma stream 2 is established by changing the angle between burners 1. An increase of the angle between the burners 1 for one degree results in an increase of the cross-sectional dimension of the overall flow 2 in the cross section under discussion of 5 mm.

Superposed on the current-carrying portions of the plasma jets is a magnetic field which is produced between the poles of the open magnetic circuit 4 by passing an electric current of 100 A from the power supply 6 through the solenoids 5.

A required cross-sectional dimension of the plasma stream 2 is determined by the processing unit 10 by setting the values of the currents $I_1$–$I_6$ at the inputs of the primary adders 13. If the dimension of the total plasma stream 2 diverge from the preset value, the primary adders 13 produce output error signals $\Delta I_1$–$\Delta I_6$ proportional to the difference between the observed and preset values of the currents of the photodiodes 12. The error signals $_\Delta I_1$–$_\Delta I_6$ are summed up by the common adder 14 whose output signals are applied to the inputs of the multipliers 15. The outputs of the multipliers 15 are outputs of the processing unit 10 and control inputs of the drive 3. In the presence of a signal at the output of the multipliers 15 and appearance of this signal at the input of the drive 3 of the plasma burners, the drive 3 will change the angle between the burners 1 until the signal from the common adder 14 is equal to zero, i.e. a preset dimension of the total plasma stream is established. In a similar way, one can change the cross-sectional dimension of the plasma stream 2 by controlling the flow rate of the plasma-forming gas with the same value of the magnetic field of the open magnetic circuit 4 or, on the contrary, by varying the magnetic field of the magnetic circuit 4 with a constant flow rate of the plasma-forming gas. In these cases, the signals of the processing unit 10 are control signals for the plasma-forming gas supply system 8 or for the source 6 to supply electric current to the solenoids. The control signal applied to the system 8 for supply of plasma-forming gas decreases or increases its flow rate thereby affecting the cross-sectional dimension of the plasma stream 2. If the control signal is sent to the source 6 supplying an electric current to the solenoids, the magnetic field superposed on each of the plasma jets also leads to a change of the cross-sectional dimension of the plasma jets.

From the above it is clear that the essence of the proposed method of control of a plasma stream formed by at least two plasma-forming gas jets consists in that these jets are acted on by electric currents flowing through them and by a magnetic field superposed on each jet. One of the physical parameters of the total plasma stream is monitored end controlled by acting on at least one plasma jet and the magnitude of this action is varied to obtain the preset values of physical parameters of the total plasma stream.

Figure 4:
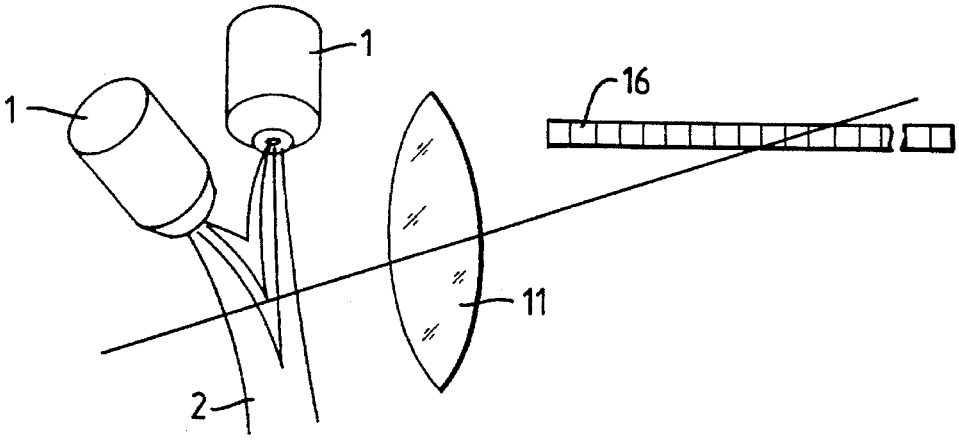
FIG. 4 shows the optical recording unit with a string of photodetectors.

The apparatus shown in FIG. 1 enables one to monitor and modify the cross-sectional dimension of the total plasma stream 2. However, one of the most informative physical parameters of the plasma stream is distribution of its radiation brightness over the cross-sectional area of this stream. The brightness helps to estimate the size of the flow, its symmetry, temperature distribution and enthalpy, i.e. the flow characteristics determining the result of the surface treatment. Shown in FIG. 4 is an optical recording unit for tracing the brightness distribution in the total plasma stream 2 including a lens 11 and a photodetector based on a string 16 of photosensitive cells. The image of the plasma stream 2 is projected by the lens 11 onto the string 16 of photosensitive cells. The photodetector may be made in the form of a series of photodiodes or a unit based on charge-coupling devices having 100 or more photosensitive cells.

Figure 5:
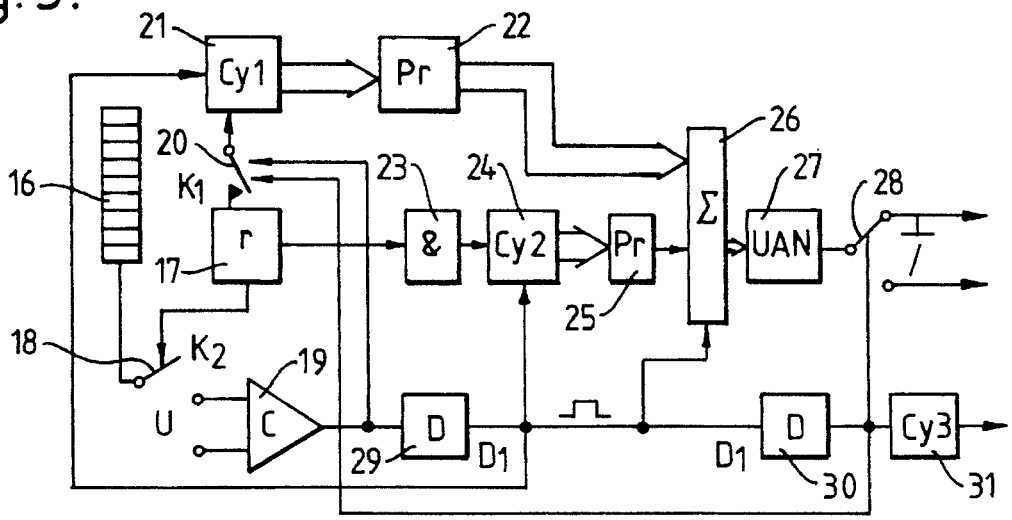
FIG. 5 shows the unit for pre-processing the signal transmitted from the string of photodetectors.

The signal from the string 16 of photosensitive cells is transmitted to a pre-processing unit whose circuit diagram is shown in FIG. 5.

In this specific circuit use is made of a string based on charge-coupling devices. The principle of operation of this circuit is based on comparison of the signal from each string with a reference signal. The coordinate of the jet center is the middle of an interval within which the level of the signal from the string 16 of charge-coupling devices exceeds the reference signal level. The circuit operates as follows.

Following the commands from the generator 17, the signals from the elements of the string 16 are transmitted through a switch 18 to a comparator 19. In the comparator 19 these signals are compared with the reference value and, when a signal from any element of the receiving string 16 reaches the reference value of the comparator 19, the latter is set to the "one" state thereby rendering the switch 20 conductive.

The output of the generator 17 is connected through the switch 20 to the input of a counter 21. As soon as the "1" signal appears at the output of the comparator 19, the switch 20 closes the circuit and the digital code at the counter 21 corresponds to the number of the element of the receiving string 16 whose output signal has coincided with the reference signal. This digital code is recorded in a register 22.

After the switch 20 has broken the circuit to the counter 21, the signals from the generator 17 are sent through an element 25 to a counter 24 until the signal from the elements of the receiving string 16 becomes lower than the reference signal. After that, the comparator 19 is put to the "zero" state and the switch 20 is closed. Therefore, the counter 24 acquires a code corresponding to the amount of cells with the signal whose level exceeds that of the reference signal.

The code of the counter 24 is applied to a shift register 25 performing an operation of division by shifting the code to the right for one position. Then, this code and the code of the register 22 are summed up in the adder 26 and sent to a digital-analog converter 27 and are applied to the input of the processing unit 10 through a switch 28.

The trailing edge of the signal passes through a delay line 28 and resets the counters 21 and 24.

The trailing edge of the signal passes through a delay line 30 and opens switches 20 and 28.

After the trailing edge of the second signal "1" has passed the delay line 30, the counter 31 produces a signal applied to the inputs of the processing unit 10 (FIG. 3).

Figure 6:
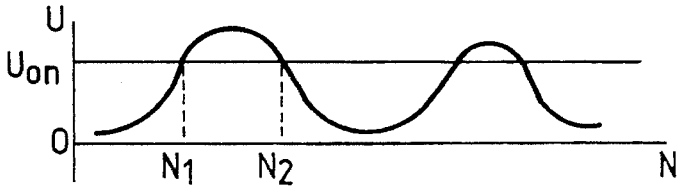
FIG. 6 is a diagram of the signal takes from the string of photodetectors.

Therefore, the inputs of the primary adders 13 of the processing unit 10 are supplied with information on the position of the centers of the jets. In a simple case, when the total plasma stream is formed of two converging jets, the projection data from the string 16 represent a double-hump curve shown in FIG. 6. The maximum position corresponds to the coordinate of the converging jets in the considered cross section of the total plasma stream 2.

In this example, the outputs of the multipliers 15 are connected to the inputs of the current supply sources 6 of the solenoids 5. In accordance with the Ampere law, the interaction of the magnetic field with the electric current flowing through the current-conducting portions of the jets initiates a force which deflect the plasma jets. If the current is changed by 10 mA, the jet center in the cross section under consideration is deflected for 3 mm. Thus, the size and shape of the overall flow 2 are controlled by varying the current flowing through the solenoid 5.

A required brightness distribution in the plasma jet is assigned in the processing unit 10 by setting the values of the currents of the primary adders 13, the information on the position of the centers obtained from the charge-coupling devices of the string 16 being applied to the same unit 10.

The operation of this unit is generally performed similarly to that described in the above example shown in FIG. 1, however, in this case the jets are acted on by controlling the magnetic field. In the presence of a signal at the output of the multipliers 15 and its appearance at the input of the current supply 6 of the solenoids 5, this signal will change the current flowing through the solenoids 5 of the magnetic system until the voltage at the output of the multipliers 15 is equal to zero indicating the brightness distribution in the total plasma stream 2 coincides with a preset value.

The brightness distribution in the total plasma stream 2 can also be controlled by varying the angle of convergence of the plasma jets, i.e. by changing the mutual position of the of the burners 1 by means of the electric drive 3 (FIG. 1), or by varying the flow rate of the plasma-forming gas in the jets. In these cases the control signals of the processing unit 10 are sent either to the electric drive 3 or to the plasma-forming gas supply system 8.

Figure 7:
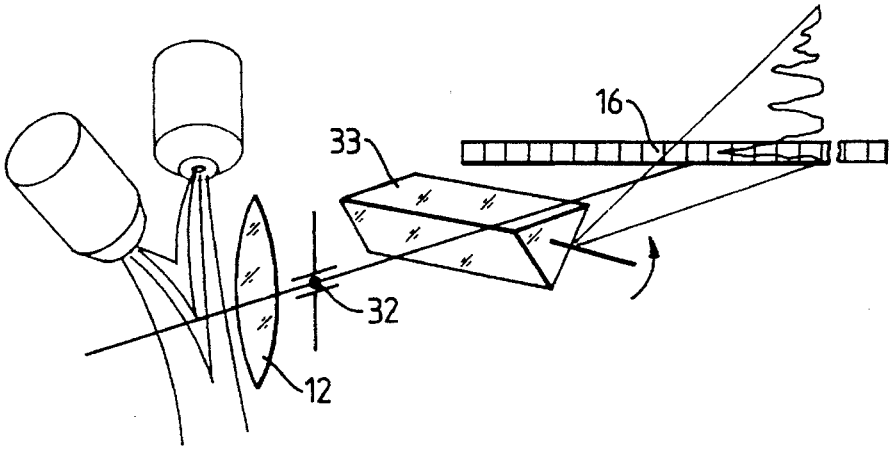
FIG. 7 shows the optical recording unit with a dispersing element.

Consider now an example of controlling the total plasma stream 2 by the results of tracking the distribution of the spectral radiation factor. This makes it possible to form and maintain very accurately a preset plasma composition, which determines the plasma treatment rate and quality. FIG. 7 illustrates an embodiment of the optical recording unit including a single-element lens 12 (similarly to the optical unit of FIG. 4) which helps to project the plasma stream image onto a slot 32 which cuts off a required projection of the flow. Installed behind the slot 32 is a dispersing element or a lens 33. The prism 33 is capable of turning about an axis normal to the optical axis of the lens 12. The radiation flux formed by the lens 12 and slot 32 passes through a prism 33 and is dispersed into a spectrum which is recorded by the coupling-charge elements of the string 16. The radiation of a definite wavelength is projected onto the coupling-charge elements of the string 16 by turning the prism 33. In so doing, a necessary value of the distribution of the radiation spectral factor on a definite wavelength is put in the processing unit 10 of the unit shown in FIGS. 1, 3. The signal taken from the coupling-charge elements of the string 16 is applied to the input of the processing unit 10 producing an output control signal applied to the input of the plasma-forming gas supply system 8, varying the gas composition, for example, by increasing the quantity of oxygen in the plasma-forming gas (nitrogen).

The apparatus shown in FIG. 1 makes it possible to control the total plasma stream by measuring the heat flow in the total plasma stream 2. The heat flow warms up the surface being treated and this affects the speed of the chemical reactions occurring in the process of treatment and can lead to non-uniform processing of the surface or to a poor quality of the treated surface.

The elements of the apparatus shown in FIG, 8 and identical to those in FIG. 1 have the same reference numerals.

In the apparatus shown in FIG. 8 the unit for recording the physical parameters of the total plasma stream 2 is made in the form of a drive 34 with holders 35 carrying a thermocouple 36. The drive 34 allows the holder 35 with the thermocouple 36 to move in a vertical direction along the plasma stream 2 and to move in a horizontal plane to cross the plasma stream 2. The thermocouple 36 is installed on the holder 35 so that its sensing area comes in contact with the plasma stream 2 when crossing it. The magnitude of the electromotive force appearing across the thermocouple is used for estimation of the heat flow in the cross section of the plasma stream 2 being measured. In a way, similar to that described above, the signal from the thermocouple 56 is transmitted to the processing unit 10 and the output signal of this unit is applied to the power supply 7 of the plasma burners 1 varying the electric current flowing therethrough.

The vertical motion of the holder 35 makes it possible to determine the heat flow at any cross section of the plasma stream 2.

During the interaction of the plasma stream with the surface being treated the plasma properties are changed considerably; the plasma acquires a state of non-equilibrium physically and chemically. Under these conditions it is reasonable to check the ion concentration in the plasma stream. The electrical conductivity of the plasma stream depends on this concentration. The higher the ion concentration, the higher the electrical conductivity.

Therefore, to measure the electrical conductivity of the plasma stream in the apparatus shown in FIG. 8, it is sufficient to install so additional counter, i.e. an electrostatic probe 37 on the holder 35. The construction of the electrostatic probe 37 is shown in FIG. 9. The electrostatic probe has an insulation plate 38, on which two conductors 39 are mounted. The lower ends of the conductors are connected to the unlike poles of a battery 40, and a current meter 41 is inserted in this circuit. The signal from the current meter 41 is applied to the input of the processing unit 10 (FIG. 8). The upper ends of the conductors are in contact with the plasma stream 2 as soon as the holder 35 starts moving in a horizontal plane. When the holder 35 crosses the plasma stream 2, the ions and electrons of the plasma start moving from one energized conductor to the other. As a result, the electric circuit is closed and an electric current starts flowing through this circuit, the value of this current being indicated by the current meter 41. The magnitude of the measured current allows one to estimate the ion concentration in the plasma stream 2. The concentration of ions can be varied similarly to the abovedescribed examples by changing the composition of the plasma-forming gas or by varying the flow rate of this gas.

In order to change the distribution of the ion concentration in the flow, several conductors 39 must be installed on the insulator 38. One conductor is connected to one terminal of the battery 40 while the rest are connected to the other terminal of the battery 40. From the output of each probe 39 a current signal is taken and sent to the input of the processing unit 10. In this case, the plasma stream is controlled in a manner similar to that described above.

Described above are preferred embodiments of the invention. It is obvious that those skilled in the art may make changes and modifications in the method and apparatus without departing from the scope of the present invention.

For example, using a more complex processing unit, one can check not only individual parameters of the plasma stream but also a set of these parameters to make them stable in time and, therefore, to attain good reproducibility of the high-quality treatment.

We claim:

1. A plasma apparatus comprising at least two plasma burners arranged at an angle relative to each other for forming a total plasma stream, the burners being connected to a power supply and to a plasma-forming gas source; each burner being provided with a magnetic system including an open magnetic circuit with a solenoid connected to a power supply; and means for monitoring a physical parameter of the total plasma stream and for controlling in response to the monitored parameter, without turning off the burners, at least one of: (a) the power supply of at least one of the plasma burners, (b) the power supply for at least one of the solenoids, and (c) the gas source for at least one of the burners.

2. The apparatus of claim 1 wherein the means for monitoring includes at least one electrostatic probe having a pair of electrodes, one end of the electrodes being positioned for contacting the total plasma stream, the other end of the electrodes being connected to a power supply and a current meter, the probe being installed for intersecting the longitudinal axis of the total plasma stream.

3. The apparatus of claim 1 wherein the means for monitoring the physical parameter includes a thermocouple positioned for intersecting the longitudinal axis of the total plasma stream.

4. The plasma apparatus of claim 1 wherein the gas source for at least one of the burners is controlled in response to the monitored parameter.

5. The plasma apparatus of claim 1 wherein the power supply of at least one of the burners is controlled in response to the monitored parameter.

6. The plasma apparatus of claim 1 wherein the power supply of at least one of the solenoids is controlled in response to the monitored parameter.

7. The plasma apparatus of claim 6 wherein the power supply of at least one of the burners is controlled in response to the monitored parameter.

8. The plasma apparatus of claim 1 wherein the flow rate of gas for at least one of the burners is controlled in response to the monitored parameter.

9. The plasma apparatus of claim 8 wherein the power supply of at least one of the solenoids is controlled in response to the monitored parameter.

10. The plasma apparatus of claim 1 wherein the angle of gas derived from the gas source for at least one of the burners is controlled relative to the total plasma stream propagation direction in response to the monitored parameter.

11. The plasma apparatus of claim 10 wherein the flow rate of gas for at least one of the burners is controlled in response to the monitored parameter.

12. The plasma apparatus of claim 11 wherein the power supply of at least one of the burners is controlled in response to the monitored parameter.

13. The plasma apparatus of claim 12 wherein the power supply of at least one of the solenoids is controlled in response to the monitored parameter.

14. A plasma apparatus comprising at least two plasma burners arranged at an angle relative to each other for forming a total plasma stream, the burners being connected to a power supply and to a plasma-forming gas source; each burner being provided with a magnetic system including an open magnetic circuit with a solenoid connected to a power supply; optical means having an optical axis intersecting a longitudinal axis of the total plasma stream, the optical means including an optical energy-sensitive cell in an image plane of the optical means for monitoring a physical parameter of the total plasma stream; and means responsive to the monitored physical parameter for controlling at least one of: (a) the power supply of at least one of the plasma burners, (b) the power supply for at least one of the solenoids, and (c) the gas source for at least one of the burners.

15. The apparatus of claim 14 wherein the optical energy-sensitive cell includes a string of photodetectors.

16. The apparatus of claim 14 further including a dispersing element located along the optical system optical axis to be optically coupled with the optical energy-sensitive cell.

17. A method of monitoring and controlling a characteristic of a total plasma stream formed by at least two converging plasma-forming gas jets which are acted on by electric currents flowing therethrough and by a magnetic field superposed on each jet, comprising the steps of monitoring a physical parameter of the total plasma stream, and in response to changes of said parameter varying (i) the intensity of a magnetic field superposed on the plasma-forming gas jets and (ii) at least one of the flow rate of the plasma-forming gas and the angle of convergence of the plasma-forming gas jets until required values of the monitored physical parameters of the total plasma stream are attained.

18. The method of claim 17 wherein the flow rate is controlled.

19. The method of claim 17 wherein the angle of convergence is controlled.

20. The method of claim 17 wherein the flow rate and angle of convergence are controlled.

21. A method of controlling a total plasma stream formed by at least two converging plasma-forming gas jets which are acted on by electric currents flowing therethrough and by a magnetic field superposed on each jet, comprising monitoring the cross-sectional dimension of the total plasma stream, and in response to changes in said monitored cross-sectional dimension, varying the total plasma stream by controlling the intensity of the magnetic field superposed on at least one of the converging plasma jets, and varying the cross-sectional dimension of the plasma stream by changing the flow rate of plasma-forming gas in at least one of the converging plasma jets.

22. A method of controlling a total plasma stream formed by at least two converging plasma-forming gas jets which are acted on by electric currents flowing therethrough and by a magnetic field superposed on each jet, comprising monitoring the brightness distribution of the total plasma stream, and in response to changes in said monitored brightness distribution, varying the intensity of the magnetic field superposed on at least one of the converging plasma jets.

23. The method of claim 22 wherein the brightness distribution of the total plasma stream is changed by varying the intensity of the magnetic field superposed on at least one of the converging plasma jets.

24. A method of controlling a total plasma stream formed by at least two converging plasma-forming gas jets which are acted on by electric currents flowing therethrough and by a magnetic field superposed on each jet, comprising monitoring a spectral radiation factor distribution of the total plasma stream, and in response to changes in said monitored spectral radiation factor distribution, varying the plasma-forming gas composition of at least one of the jets.

25. The method of claim 24 wherein the spectral radiation factor distribution is modified by varying the plasma-forming gas flow rate in response to the monitored spectral radiation factor distribution.

26. A method of controlling a total plasma stream formed by at least two converging plasma-forming gas jets which are acted on by electric currents flowing therethrough and by a magnetic field superposed on each jet, comprising monitoring the ion concentration of the total plasma stream, and in response to changes in said monitored ion concentration, varying the plasma-forming gas composition in at least one of the plasma jets.

27. The method of claim 26 wherein the ion concentration in the plasma stream is modified by varying the plasma-forming gas flow rate in at least one of the plasma jets in response to the monitored ion concentration in the plasma stream.

* * * * *